US005435829A

United States Patent [19]

Fister et al.

[11] Patent Number: 5,435,829

[45] Date of Patent: Jul. 25, 1995

[54] MOLYBDENUM POWDER MIXTURE FOR TZM

[75] Inventors: Dietmar Fister, Murg; Wolfgang Wiezoreck, Laufenberg, both of Germany

[73] Assignee: H. C. Starck GmbH & Co. KG, Goslar, Germany

[21] Appl. No.: 240,609

[22] Filed: May 10, 1994

Related U.S. Application Data

[63] Continuation of Ser. No. 7,168, Jan. 21, 1993, abandoned.

[30] Foreign Application Priority Data

Oct. 29, 1992 [DE] Germany ..... 92 14 709 U

[51] Int. Cl.[6] ..... C22C 27/04

[52] U.S. Cl. ..... 75/252; 420/429

[58] Field of Search ..... 75/252, 236, 238, 241; 420/429

[56] References Cited

U.S. PATENT DOCUMENTS

| | | | |
|---|---|---|---|
| 3,275,434 | 9/1966 | Chang | 420/429 |
| 3,447,921 | 6/1969 | Chang | 420/429 |
| 3,890,137 | 6/1975 | Beyer et al. | 75/252 |
| 5,149,361 | 9/1992 | Iyori et al. | 75/236 |
| 5,149,595 | 9/1992 | Kajo et al. | 75/241 |
| 5,348,806 | 9/1994 | Kajo et al. | 75/241 |

OTHER PUBLICATIONS

Ryan, N. B., et al., "Carbide Growth in a Molybdenum TZC Alloy," J. of Materials Science, V. 4, pp. 471–478, 1969.

*Primary Examiner*—George Wyszomierski
*Attorney, Agent, or Firm*—Jerry Cohen

[57] ABSTRACT

The present invention relates to a pulverulent material for the production of standardized TZM parts by sintering techniques, as well as the notion of using pulverulent nitridic or carbonitridic hard materials as alloying components in the production of the abovementioned alloy by melt-metallurgical processes (electron beam melting, arc melting).

6 Claims, No Drawings

MOLYBDENUM POWDER MIXTURE FOR TZM

This is a continuation of application Ser. No. 08/007,168, filed Jan. 21, 1993, now abandoned.

The present invention relates to a pulverulent material for the production of standardised TZM parts by sintering techniques, as well as the use of pulverulent nitridic or carbonitridic hard materials as alloying components in the production of the abovementioned alloy by melt-metallurgical processes (electron beam melting, arc melting).

Various types of molybdenum alloys with high heat resistance and creep strength are known. The most important of these is employed in industry under the name TZM and is usually produced by powder-metallurgical processes by adding the appropriate quantifies of titanium hydride, zirconium hydride and carbon, as well as carbides/oxides of the corresponding metals and carbon (carbon black).

In addition to the alloy TZM (of which the main component is molybdenum together with 0.5% of Ti, 0.08% of Zr and 0.01 to 0.04% of C) other alloys, such as for example:

ZHM (Mo+0.72% Zr, 0.14% Hf and 0.05–0.1% C)
TZC (Mo+about 1% Ti, about 0.14% Zr and about 0.1% C)
MHC (contains hafnium carbide)
molybdenum, doped with potassium/silicon oxide
molybdenum/lanthanum oxide
ZHM+oxides such as $ThO_2$ and $La_2O_3$ are also employed in industry.

Due to the outstanding mechanical and thermal properties of these alloys, and in particular TZM, they are highly important for high-temperature applications (reaction boats, electrodes, structural parts of furnaces, etc.).

In order to improve the mechanical high-temperature properties of the refractory metal molybdenum, which in the pure state has a very high tendency to recrystallise and thus also to become brittle, attempts have been made for many years to improve the negative properties of this important material by the use of various additives.

In industrial practice the melt-metallurgical production of TZM is carded out by adding the alloying elements and carbon in elemental form. As a result of dissolution and precipitation processes, grain boundary precipitates form which are particularly responsible for raising the embrittling and recrystallisation temperature of molybdenum.

Particularly in high vacuum melt-metallurgical production processes the above method has the disadvantage that, especially in the case of titanium, the required end concentrations can only be precisely adjusted with great difficulty due to titanium's high vapour pressure. This can usually only be controlled by the empirical adjustment of the melt parameters and the quantity of the alloying element added.

The object of the present invention is therefore to provide a powder mixture for further processing by customary powder-metallurgical processes or a suitable combination of hard materials for adjusting alloy formation in the melt-metallurgical production of TZM, which avoids the abovementioned disadvantages encountered in industrial practice.

Contrary to various statements made in the literature it has surprisingly been found that, when using suitably treated carbides and carbonitrides or nitrides and appropriately adapting the methods employed for sintering and subsequent melt-metallurgical processing, a standardised TZM alloy with a low $N_2$ content can be produced. From the information contained in the literature and thermodynamic calculations it would actually have been expected that nitride precipitates would also form on the grain boundaries in addition to carbides. This would produce undesired changes in the properties of the end product.

A very important aspect of this process is considered to be the fact that both the metal and the carbon contents in the end product can be precisely adjusted by the use of relatively readily decomposable nitrides. Although a special sintering technique is required for this purpose, such techniques are not unfamiliar to powder-metallurgical experts. A further advantage of the proposed process is that the metal nitrides, carbides and/or carbonitrides can be relatively easily comminuted to the required particle size in attritors or in other grinding apparatus to particle sizes of $<5$ μm (sedigraph). By means of a special mixing/grinding technique the fine hard material powders can be homogeneously dispersed in the molybdenum metal powder.

As might have been expected it has been found that the nitrides or carbonitrides can be ground to the required fineness more economically than the carbides mentioned in the literature or the corresponding metal powders.

One preferred embodiment of the present invention comprises using titanium and zirconium in the form of nitrides or a portion of the titanium in the form of a carbide, in order to include a proportion of carbidic carbon in the form of bound carbon. It is however also very important to carefully adjust the maximum particle size of the starting hard materials to $<5$ μm and to use a special processing method for the production of the mixtures and the further processing thereof by powder-metallurgical techniques.

It has also surprisingly been found that TiN, for example, as well as ZrN, and even TiZrCN in corresponding ratios form a suitable material for the melt-metallurgical production of the TZM alloy.

Thus the present invention relates to a molybdenum powder mixture containing powder particles of carbides, carbonitrides and/or nitrides of titanium and zirconium and free carbon in the form of carbon black in such a quantitative ratio that the weight ratio of titanium to (elementary) zirconium in the powder mixture is between 4 and 9, the weight ratio of titanium to carbon (bound and free) is between 3 and 7, the particle size of all of the mixture components is less than 5 μm (sedigraph), and in addition the weight ratio of the contents of bound nitrogen and bound carbon is at least 0.7, and preferably at least 1, and in particular 1.5 to 3.

The present invention relates to a molybdenum powder mixture which contains as the masterbatch a quantity of powder particles excluding molybdenum of from 5 to 20% by weight of the total mixture.

The invention also relates to the further processing of the masterbatch to form a molybdenum powder mixture in which the quantity of powder particles excluding molybdenum is from 0.6 to 0.9% by weight of the total mixture and which can be converted directly into a TZM alloy by powder-metallurgical processes.

In the preferred embodiment of the present invention TiN, TiC and ZrN, which have been carefully pretreated for powder-metallurgical processing and have suitable particle sizes, as well as lamp black, are intimately mixed with the molybdenum powder in such a manner that a highly concentrated premix is produced. The mixture is produced in such a manner that the hard materials are initially introduced into a positive mixer and gradually "diluted" with the molybdenum metal powder. The ingredients can be mixed in the dry or the wet state.

This method of procedure is particularly advantageous since it ensures the optimum dispersion of the hard materials in the molybdenum matrix. Detrimental inhomogeneities/agglomerations can thus be substantially avoided.

A further preferred embodiment of the present invention is the use of nanocrystalline hard materials (with particle sizes of <500 nm), particularly in the powder-metallurgical production of the abovementioned alloys.

The hard materials TiC, TiN, ZrC, ZrN, TiZrC, TiZrCN and TiZrN preferred according to the invention are either ground to particle sizes of <5 μm by industrially known processes, or produced in correspondingly fine particle sizes by reaction in the gas phase. Compounds of the 5th subgroup of the periodic table of the elements or rare earth carbonitrides can also be used as alloying additives.

EXAMPLE 1

The components TiC, TiN and ZrN to be contained in the TZM powder mixture were attritor-ground to 100% <5 μm (sedigraph) and then screened at −70 μm. A molybdenum metal powder with a FSSS of 5 μm was screened at 63 μm.

In a plough share mixer a premix (1) was prepared from 31% by weight of TiC, 48% by weight of TiN, 14% by weight of ZrN and 7% by weight of fine carbon black. This mixture (1) was initially introduced into the plough share mixer in an amount of 15% by weight and 85% by weight of MoMP (mixture (2)) were added slowly over a period of 1 hour. This mixture is used as a mastermix 1:20 for the production of finished TZM powder mixtures.

Mixture (2) was then initially introduced into the plough share mixer in an amount of 5% by weight and 95% by weight of MoMP were added. After a mixing time of 15 minutes and precautionary screening at −150 μm, the TZM powder mixture (3) is produced, which can be processed directly by powder-metallurgical techniques to form sintered parts.

By using mixers of suitable sizes and designs (with rotating knife heads) it must be ensured that the powders are disagglomerated and homogeneously mixed.

EXAMPLE 2

In accordance with Example 1 TiCN (30/70) and ZrC were attritor-ground and screened.

70% by weight of TiCN (30/70) and 17% by weight of ZrC were mixed with 7% by weight of carbon black in a plough share mixer (mixture (1)).

In accordance with Example 1 this mixture with MoMP was processed further to form the finished TZM powder mixture (3).

EXAMPLE 3

In accordance with Example 1 TiCN (50/50) and ZrN were attritor-ground and screened.

79% by weight of TiCN (50/50) were mixed with 15% by weight of ZrN and 6% by weight of carbon black in a plough share mixer (mixture 1)). This premix was processed further according to Example 1 to produce a finished TZM powder mixture.

FSSS=Fisher sub-sieve sizer

MoMP=99.9% molybdenum powder

We claim:

1. A molybdenum powder mixture containing powder particles of carbides, carbonitrides and/or nitrides of titanium and zirconium and free carbon in the form of carbon black in such a quantitative ratio that the weight ratio of titanium to (elemental) zirconium in the powder mixture is between 4 and 9, the weight ratio of titanium to carbon (bound and free) is between 3 and 7, the particle size of all of the components of the mixture is smaller than 5 μm, and the weight ratio of the contents of bound nitrogen and bound carbon is at least 0.7 and wherein the quantity of powder particles excluding molybdenum is from 5 to 20% by weight of the total mixture.

2. A molybdenum powder mixture containing powder particles of carbides, carbonitrides and/or nitrides of titanium and zirconium and free carbon in the form of carbon black in such a quantitative ratio that the weight ratio of titanium to (elemental) zirconium in the powder mixture is between 4 and 9, the weight ratio of titanium to carbon (bound and free) is between 3 and 7, the particle size of all of the components of the mixture is smaller than 5 μm, and the weight ratio of the contents of bound nitrogen and bound carbon is at least 0.7. and wherein the quantity of powder particles excluding molybdenum is from 0.6 to 0.9% by weight of the total mixture.

3. Molybdenum powder mixture according either of claims 1 or 2, in which the powder particles excluding molybdenum have a particle size of below 500 nm.

4. A master powder particle mixture for use in making molybdenum based alloys, essentially all of the particles of the mixture being of a particle size smaller than 5 μm, the mixture being usable, after several fold dilution by intimate and well dispersed further mixture with molybdenum particles in subsequent production of molybdenum alloys by powder-metallurgy and/or melt processing, the original said master mixture containing particles of chemical composition selected from the group consisting of carbonitrides and nitrides of titanium and/or zirconium, and further comprising carbon in the form of a material selected from the group consisting of elemental carbon, carbides and carbonitrides of titanium and/or zirconium, the foregoing in such a quantitative ratio that the weight ratio of titanium to (elemental) zirconium in the original powder mixture is between 4 and 9, the weight ratio of titanium to carbon (bound and free) is between 3 and 7, and the weight ratio of the contents of bound nitrogen and bound carbon is at least 0.7.

5. Powder mixture in accordance with claim 4 wherein the mixture comprises less than 0.1 w/o elemental carbon, but comprises a carbide or carbonitride of titanium and/or zirconium in an amount sufficient to introduce carbon into the ultimate molybdenum alloy and further comprises an additional nitride and/or carbonitride of zirconium.

6. A molybdenum mastermix or master-premix powder mixture comprising a powder mixture in accordance with either of claims 7 or 8 dispersed within molybdenum particles.

* * * * *